US006283035B1

(12) United States Patent
Olson et al.

(10) Patent No.: US 6,283,035 B1
(45) Date of Patent: Sep. 4, 2001

(54) REDUCED PROPELLANT AMMUNITION CARTRIDGES

(75) Inventors: Douglas D. Olson; Michael G. Adkins, both of Vero Beach, FL (US)

(73) Assignee: Knight Armamant Company, Vero Beach, FL (US)

( * ) Notice: Subject to any disclaimer, the term of this patent is extended or adjusted under 35 U.S.C. 154(b) by 0 days.

(21) Appl. No.: 09/544,128

(22) Filed: Apr. 6, 2000

(51) Int. Cl.[7] ..... F42B 8/12; F42B 5/26
(52) U.S. Cl. ..... 102/447; 102/447; 102/439
(58) Field of Search ..... 102/447, 439, 102/513

(56) References Cited

U.S. PATENT DOCUMENTS 228,494 * 6/1880 Valentine ..... 102/447
788,266 * 4/1905 King et al. .
4,157,684 * 6/1979 Clausser .
4,682,545 * 7/1987 Jett, Jr. ..... 102/430
4,867,065 * 9/1989 Kaltmann et al. ..... 102/444
5,770,815 * 6/1998 Watson, Jr. ..... 102/447
5,822,904 * 10/1998 Beal ..... 42/76.01

FOREIGN PATENT DOCUMENTS

0049125-A1 * 4/1982 (GB) .

* cited by examiner

*Primary Examiner*—Charles T. Jordan
*Assistant Examiner*—Lulit Semunegus
(74) *Attorney, Agent, or Firm*—Carroll F. Palmer

(57) ABSTRACT

Reduced propellant ammunition cartridges, particularly subsonic cartridges for clandestine use of weapons which normally fire supersonic projectiles, include a length of pliable tubing that has an outside diameter just slightly smaller than the inside diameter of the cartridge neck portion that holds the projectile with such tubing having a length that allows it to snugly fit between the base of the cartridge case and the cartridge neck portion. Such a sized tube is inserted through the neck portion and then its distal end is expanded below the cartridge neck portion to be held captive in the cartridge case. The propellant charge is contained inside the pliable tube by the rear end portion of the casing at its distal end and the projectile at its proximal end.

8 Claims, 5 Drawing Sheets

REDUCED PROPELLANT AMMUNITION CARTRIDGES

BACKGROUND OF THE INVENTION

1. Field of the Invention

This application relates to reduced propellant ammunition cartridges, particularly subsonic cartridges for clandestine use of weapons which normally fire supersonic projectiles.

2. Description of the Prior Art

There is a requirement for subsonic cartridges for clandestine use of weapons which normally fire supersonic projectiles. These subsonic rounds need to work interchangeably with supersonic rounds in so far as they need to fit properly in the same firearm chamber. While it seems it should be an easy job to produce the subsonic rounds by simply reducing the propellant charge until the velocity is adequately reduced, it is known in the art this does not work for a number of reasons.

When the propellant charge becomes small in relation to the total volume within the cartridge case, ignition of the propellant changes with respect to the location of that propellant within the case. Thus, shooting upward with the propellant charge near the primer gives different velocity results than when shooting downward with the propellant charge forward. It is also known that some small charge weights can burn at a very high rate thereby producing chamber pressures above that of full velocity rounds that can cause the cartridge to explode in the weapon with catastrophic results.

Through the years, a number of solutions have been tried which include addition of inert and consumable filler materials as well as addition of expandable inner sleeves that occupy the empty space between the propellant and the projectile, e.g., see U.S. Pat. No. 4,157,684.

The inert and consumable filler materials create problems related with their mass, water retention, combustility and by-products of combustion. Further, they can suffer from inability to keep the propellant from migrating into them due to vibration and handling shocks whereby they have an effect on ignition of the propellant.

The use of expandable inner sleeves limit the production rate in automated loading equipment due to the time it takes the sleeves to expand following insertion and the need to check to assure the sleeve has expanded prior to loading the propellant.

The result of such prior attempts to solve the production of reliable subsonic cartridges has been subsonic rounds that have a larger spread in velocity and thus less accuracy potential than what is desired while associated production costs can be significantly more then full velocity rounds.

Other attempted solutions to the problems associated with the production of subsonic ammunition have been disclosed. For example, see U.S. Pat. No. 5,822,904 which teaches use of stepped down stages in the discharge end of cartridge casings and U.S. Pat. No. 5,770,815 which teaches use of reducing internal casing volume with molded foam fillers as alternative possible solutions.

The present invention provides an improved solution to the subsonic ammunition problems that makes it possible to manufacture better and more price competitive subsonic ammunition then has been possible heretofore.

OBJECTS

A principal object of the invention is the provision of improved forms of reduced propellant ammunition cartridges, particularly subsonic cartridges for clandestine use of weapons which normally fire supersonic projectiles.

Further objects include:

1. Improving the overall efficiency of subsonic ammunition by limiting the weight to just what is required for accelerating the projectile to the desired charge velocity.
2. Creating subsonic ammunition that has no more kinetic energy than just that required for accelerating the projectile.
3. Enabling the internal modification of standard cartridges for given weapons to be of minimum volume to handle only the propellant required to create the desired subsonic cartridge.
4. Lowering the manufacturing costs of creating subsonic ammunition.
5. Providing an improved method for manufacture of subsonic ammunition that is easily adapted to existing loading equipment.
6. Providing an improved method for manufacture of subsonic ammunition that can be adapted to a wide variety of cartridge case sizes and designs.

Other objects and further scope of applicability of the present invention will become apparent from the detailed descriptions given herein. It should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of a simple and economical method of converting existing cartridge cases to hold less than the standard volume of propellant while eliminating the serious ignition and filler problems known to arise with prior art subsonic ammunition.

Basically, the invention depends upon the use of a length of pliable tubing that has an outside diameter just slightly smaller than the inside diameter of the casing neck portion that holds the cartridge projectile. The tubing is cut to a length that allows it to snugly fit between the base of the cartridge case and the casing neck portion.

Such a sized tube is inserted through the neck portion and then the distal end of the tube is manipulated so it expands below the neck portion and is thus held captive in the cartridge case. Such manipulation can advantageously be swaging of the distal end with a tool or by the rear end of the projectile that is installed in the cartridge.

The pliable tube is advantageously made of metal, particularly aluminum metal, but brass or other malleable metal may be used. Also, such tube may be made of plastic, particularly, plastic that can be deformed like metal by swagging or by use of a heated shaping tool.

The wall thickness of the pliable tube is chosen so the volume that is provided inside the tube below the base of the projectile and above the base of the casing is nearly equal to the required propellant charge need to achieve the desired velocity. In this way, the propellant charge is confined to a volume ideal to the requirements of the round. Thus, when the primer is struck by the firing pin, the propellant inside the tube is sufficiently contained by the pliable tube to assure proper propellant ignition continues while the tube is swollen or ruptured. This allows the propelling gases to fill the remaining internal volume of the cartridge case. The strength of the tube is such, however, that the propellant is properly ignited and burning before the tube swells or ruptures so the propellant continues burning in a normal manner with the net result being that proper projectile velocity is maintained to move the projectile down the firearm barrel at the proper velocity without having to expend any energy in propelling filler material down the barrel with it.

The efficiency of subsonic ammunition as provided by the invention is thus improved relative to prior known subsonic ammunition. Furthermore, the modification of the cartridge in accordance with the invention has only to deal with the minimum required amount of propellant gases. Also, since ammunition created in accordance with the invention does not need to include filler material, the firearm silencer is not effected by having to handle filler material both from an impact standpoint and from the possibility of being plugged up by filler.

BRIEF DESCRIPTION OF THE DRAWINGS

A more complete understanding of the invention can be obtained by reference to the accompanying drawings in which generic parts of the illustrated matter are indicated by arrowhead lines associated with the designation numerals while specific parts are indicated with plain lines associated with the numerals and wherein.

DESCRIPTION OF THE PREFERRED EMBODIMENTS

Figure 1:
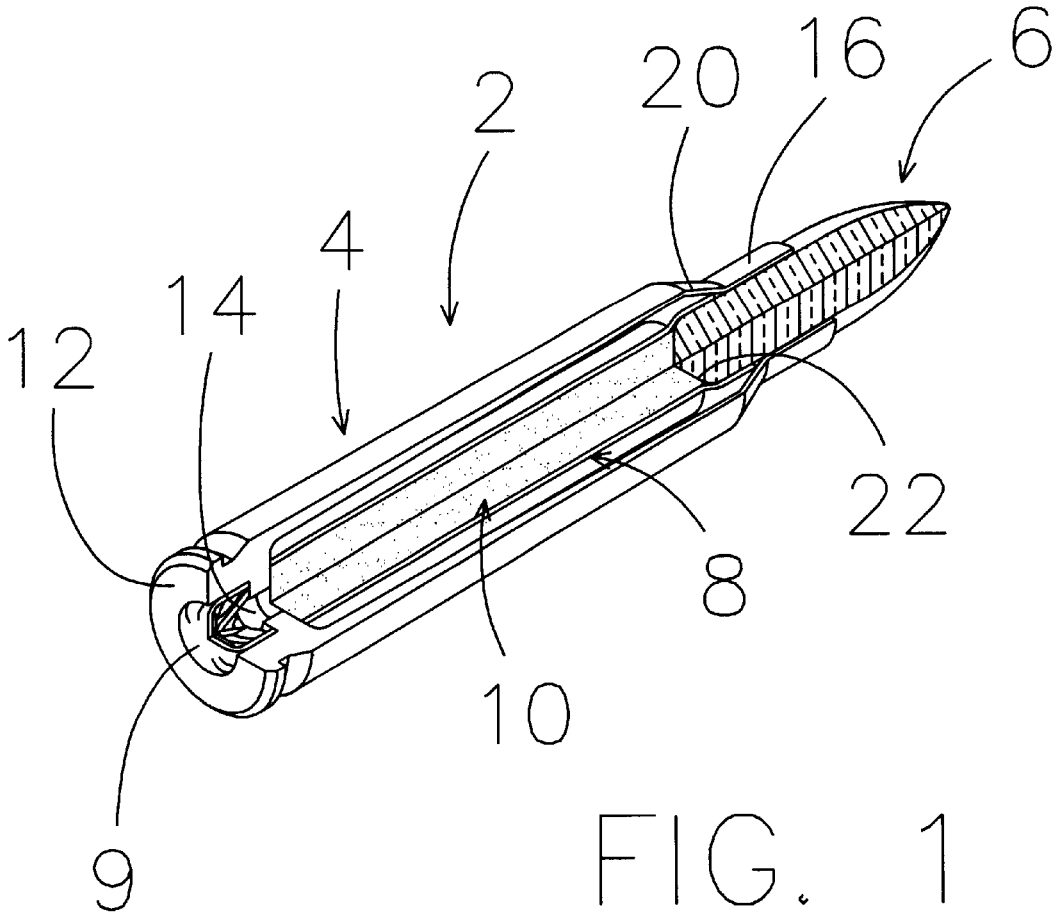
FIG. 1 is partially sectioned isometric view of a reduced propellant ammunition cartridge in accordance with the invention.

Referring in detail to the drawings, a reduced propellant ammunition cartridge 2 in accordance with the invention basically comprises a cylindrical case 4, a projectile 6, a pliable tube 8, a primer 9 and a powder charge (propellant) 10.

The cylindrical case 4 is defined by a rear end portion 12 with the primer 9 and a primer flash hole 14 centered therein, a front end portion 16 having a predetermined inside diameter, a powder chamber 18 of diameter greater than such predetermined inside diameter and a tapered neck portion 20 integrally joining the front end portion 16 to the powder chamber 18.

The projectile 6 has a cylindrical base 22 ceased in the front end portion 16 of the cylindrical case 4. Projectiles used in accordance with the invention may take a variety of shapes know to the ammunition art. By way of examples, the projectile 6 of FIG. 1 has a body of substantially uniform diameter rearward of its pointed end while projectiles **6*a* of FIGS. 5–11** are of the so-called boat type with rearward ends of reduced diameter.

The tube 8 is defined by a proximal end 24, a distal end 26 and a central body portion 28 integrally joining the proximal end 24 to the distal end 26.

Figure 2:
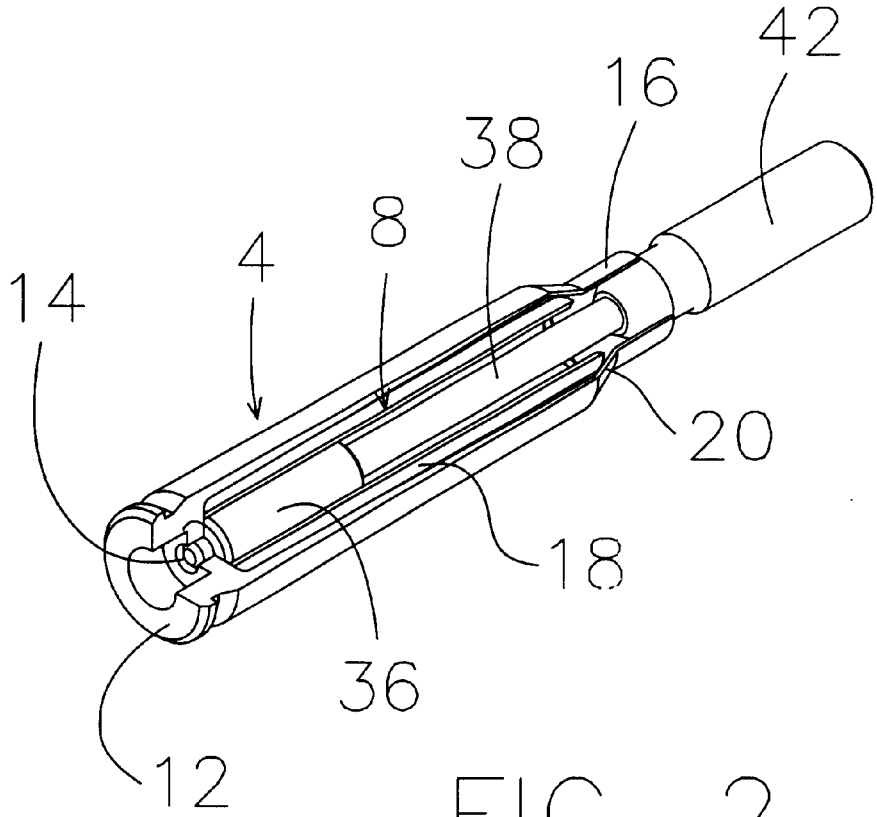
FIG. 2 is a partially sectioned isometric view illustrating one stage in the production of a reduced propellant ammunition cartridge in accordance with one embodiment of the invention.
Figure 3:
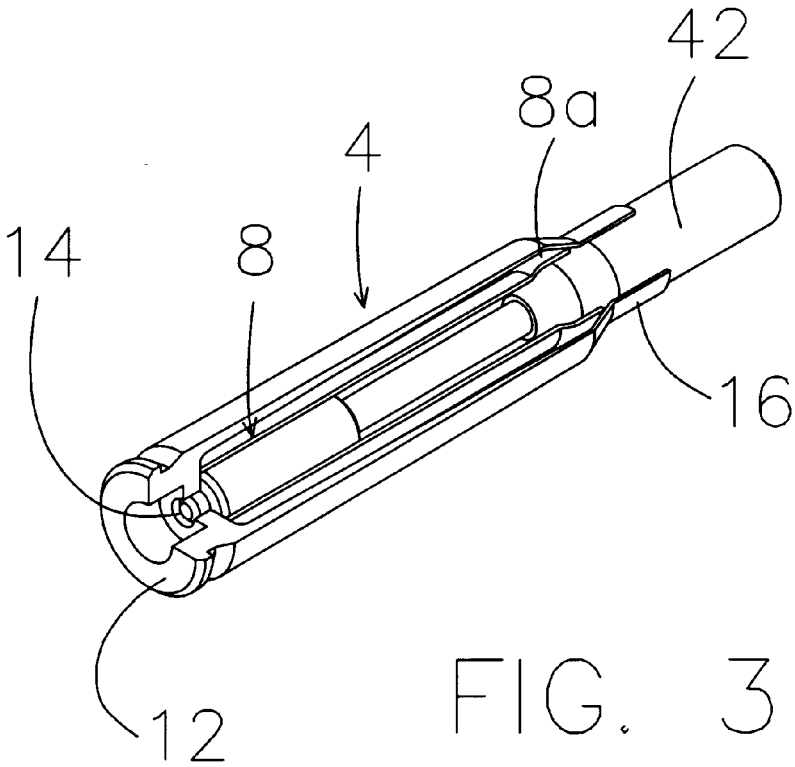
FIG. 3 is a partially sectioned isometric view illustrating a later stage in the production of a reduced propellant ammunition cartridge as shown in FIG. 2.
Figure 4:
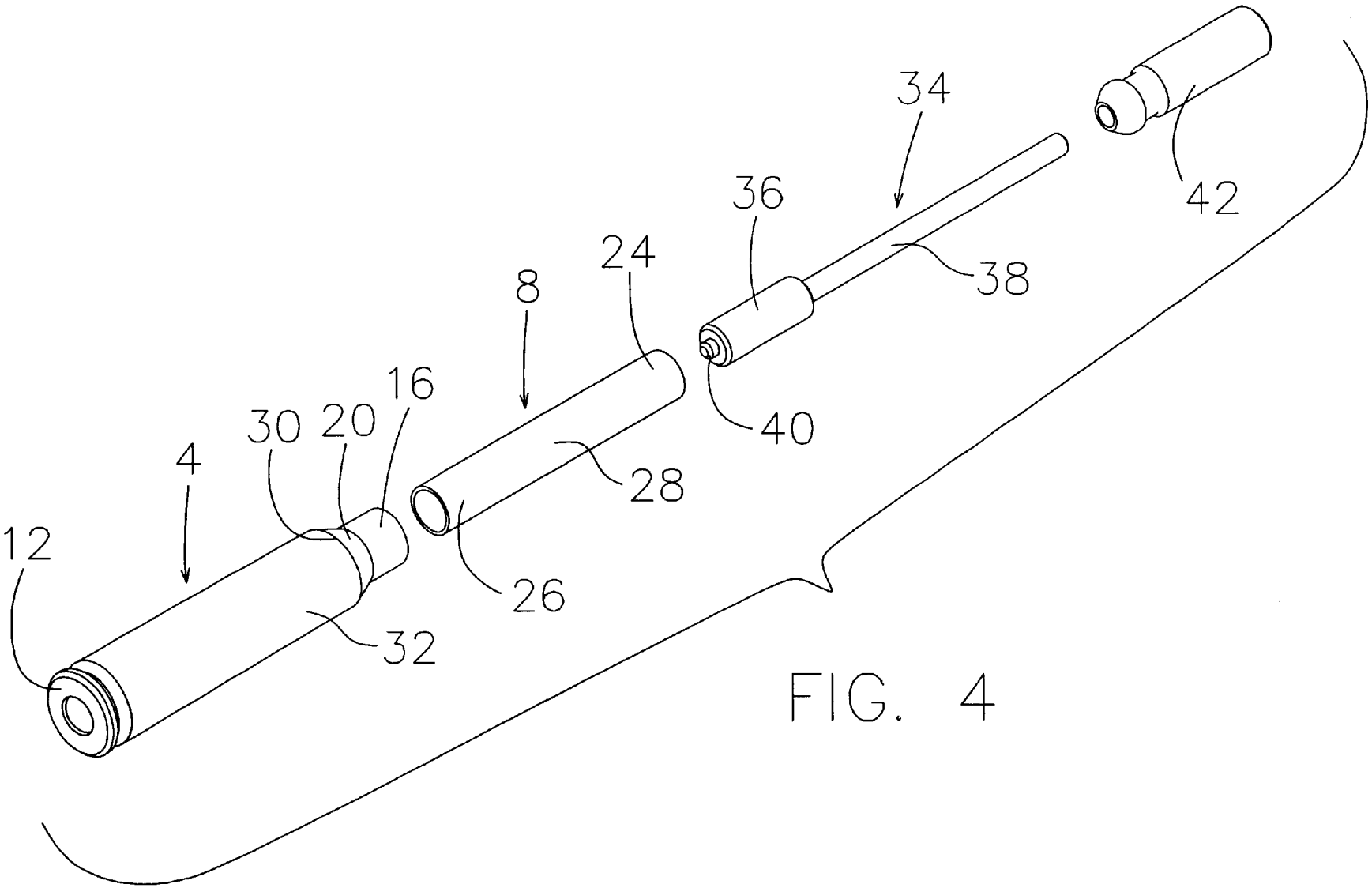
FIG. 4 is an exploded view illustrating components and tools employed in one embodiment of the production of reduced propellant ammunition cartridges in accordance with the invention.

In the finished cartridge 2, the distal end 26 and central body portion 28 of the tube 8 have an outside diameter slightly less than the predetermined inside diameter of the front end portion 16 of the cylindrical case 4, while the proximal end has been enlarged by swaging to engage the tapered neck portion 20 (see FIG. 3). Before the swaging, the entire length of the tube 8 is of the same outside diameter (see FIG. 2).

The tube 8 is enclosed by and axially aligned with the cylindrical case 4 with its distal end 26 engaging the rear end portion 12 and encircling the primer flash hole 14 of the cylindrical case 4.

The tube 8 is of predetermined length so that the proximal end 24 thereof extends to the tapered neck portion 20 cylindrical case 4 and the proximal end portion 24 is swagged into engagement with the tapered neck portion 20 (see FIG. 3).

The powder charge 10 of the ammunition cartridge 2 is solely contained inside the tube 8 by the rear end portion 12 at the distal end 26 and the projectile cylindrical base 22 at the proximal end 24.

In preferred embodiments of the reduced propellant anunnition cartridge 2, the tube 8 is made of aluminum, but it may be made of brass or other malleable metal. Alternatively, the tube 8 may be made of plastic. Also, the thickness of the tube 8 is predetermined to control the maximum quantity of powder charge 10 contained within the ammunition cartridge 2.

A preferred process for the production of a reduced propellant ammunition cartridge 2 in accordance with the invention can be accomplished in a series of basic steps that can be described with reference particularly to FIG. 2.

One step is to provide a cylindrical case 4 defined by a rear end portion 12 with a primer flash hole 14 centered therein, a front end portion 16 having a predetermined inside diameter, a powder chamber 18 of diameter greater than said predetermined inside diameter and a tapered neck portion 20 integrally joining said front end portion 16 to said powder chamber 18.

Another step involves providing a projectile 6 having a cylindrical base 22 to be ceased in front end portion 16 of the cylindrical case 4.

Yet another step is to provide a tube 8 defined by a proximal end 24, a distal end 26 and a central body portion 28 integrally joining the proximal end to the distal end with the outside diameter of the tube 8 being slightly less than the aforesaid predetermined inside diameter of the front end portion 16 of casing 4. Also, the tube 8 is of a predetermined length defined by the distance from the rear end portion 12 of the cylindrical case 4 to approximately the junction 30 of the tapered neck portion 20 with the front end portion 26 of the cylindrical case 4.

A further step is the provision of a primer cap 9.

Following the provisioning steps, one inserts the tube 8 into the cylindrical case 4 to contact the distal end 26 with the rear end portion 12 of the cylindrical case 4. This can be accomplished by the use of a positioning tool 34 comprising a pliable cylindrical pusher member 36 fixed to the end of a rod 38 and having a centering nib 40 extending at the forward end of the pusher member 36. The pusher member is designed to snugly fit into the tube 8 up to the distal end 26 so that the tube 8 can be moved into the cylindrical case 4 up to the rear end portion 12 so that the nib 40 centers into the flash hole 14.

With the tube 8 properly positioned within the casing 4 as described, the proximal end 24 of the tube 8 is swagged to the neck portion 20 (see FIG. 3) of the cylindrical case 4 using a swagging tool 42 which slides along the rod 38 for centering with respect to the distal end 24 of the tube 8. Upon completion of the swagging operation, the swagging tool 42 and positioning tool 34 are withdrawn from the cylindrical case 4.

Next, the primer cap 9 is installed in its receptive cavity of rear end portion 12 using a charging procedure and device well known to the art.

Then a predetermined volume of propellant powder 10 is charged into the swagged tube 8*x* through the front end portion 16 of the cylindrical case 4.

Finally, the reduced propellant ammunition cartridge 2 is completed by inserting the projectile 6 in the front end portion 16 of the cylindrical case 4 and, if desired crimping the front end portion 16 using any insertion or crimping procedure and device well known to the art.

Figure 5:
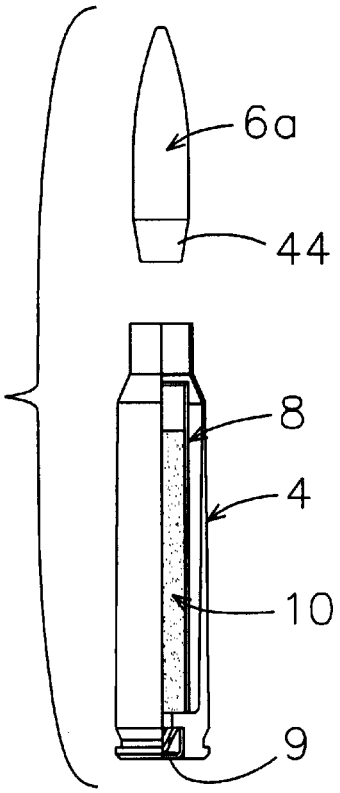
FIGS. 5–7 are partially sectioned isometric views illustrating a second embodiment of the production of reduced propellant ammunition cartridges in accordance with the invention.
Figure 6:
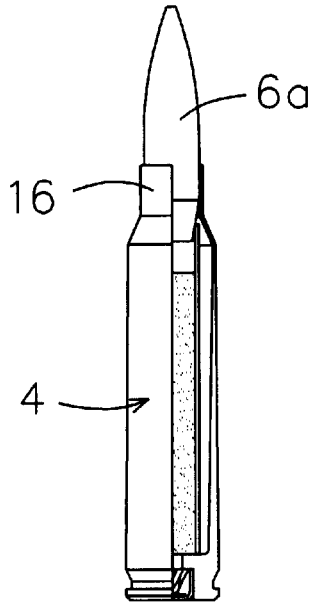
Figure 7:
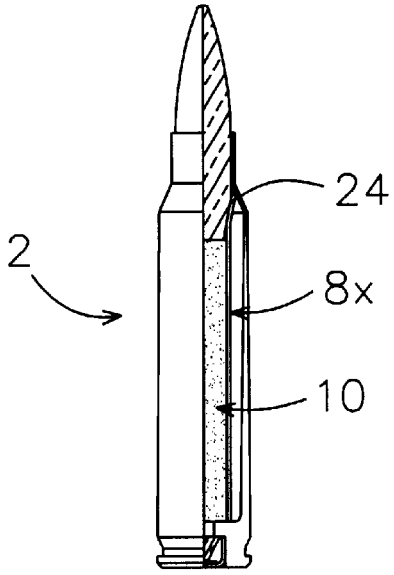

Another method for production of reduced propellant ammunition cartridges in accordance with the invention can be recognized by reference to FIGS. 5–7. In this embodiment, after the provisioning steps and installation of the primer 9 in the cylindrical case 4, the pliable tube 8 is centrally positioned within the vertically positioned case 4 after which the propellant 10 is charged into the tube 8 (FIG. 5). Then, the boat end projectile 6*a* is introduced into the front end portion 16 of the case 4 (FIG. 6) and followed by ramming home the projectile 6*a* so its taped base 44 expands the proximal end 24 of tube 8 to produce the final cartridge 2 with the captured tube 8*x* enclosing the propellant charge 10 (FIG. 7).

Figure 11:
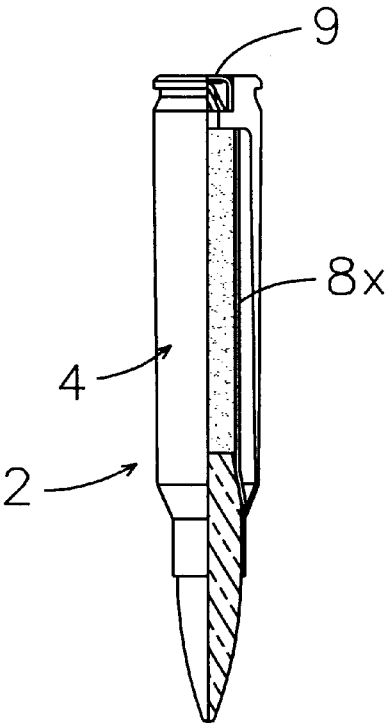
FIGS. 8–11 are partially sectioned isometric views illustrating a third embodiment of the production of reduced propellant ammunition cartridges in accordance with the invention.
Figure 10:
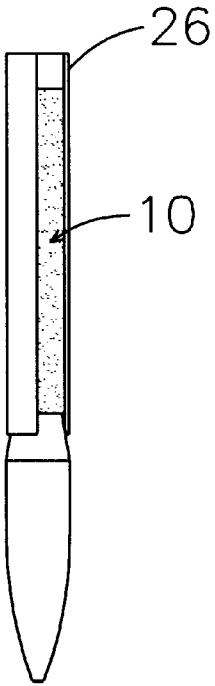
Figure 9:
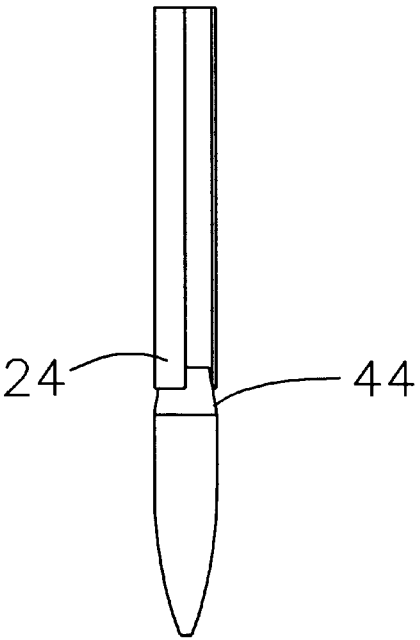
Figure 8:
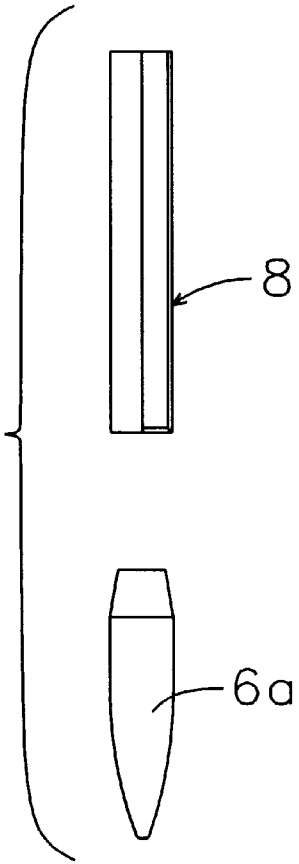

A further method for production of reduced propellant ammunition cartridges in accordance with the invention can be understood by reference to FIGS. 8–11. In this embodiment, after the provisioning steps, the boat end projectile 6*a* and pliable tube 8 are vertically positioned so the proximal end 44 of tube 8 engages the tapered end 44 of the projectile 6*a* (FIGS. 8 & 9). Propellant 10 is then charged through the distal end 26 of tube 8 (FIG. 10) and this is followed by slipping the cylindrical case 4 with an installed primer 9 about the assembly shown in FIG. 10 and forcing the projectile 6*a* into the case 4 to produce the final cartridge 2 with the captured tube 8*x* enclosing the propellant charge 10 (FIG. 11).

In the further method just described, an alternative is to install the primer 9 after the case 4, without the primer 9 (not shown), has been forced about the tapered end 44 of the projectile 6*a*.

What is claimed is:

1. In a reduced propellant ammunition cartridge including:

a cylindrical case defined by a rear end portion having a primer cap and a flash hole centered therein, a front end portion having a predetermined inside diameter, a powder chamber of diameter greater than said predetermined inside diameter and a tapered neck portion integrally joining said front end portion to said powder chamber and a cylindrical projectile having a portion ceased in said front end portion of said cylindrical case, the improvement which comprises:

a pliable tube defined by a proximal end, a distal end and a central body portion integrally joining said proximal end to said distal end, said distal end and central body portion of said pliable tube having an outside diameter slightly less than said predetermined inside diameter, said pliable tube being enclosed by and axially aligned with said cylindrical case with said distal end engaging said rear end portion and encircling said primer flash hole said pliable tube being of predetermined length that said proximal end thereof, extends to said tapered neck portion with said proximal end portion being expanded into engagement with said tapered neck portion, and a propellant charge solely contained within said ammunition cartridge inside said pliable tube by said rear end portion at said distal end and said projectile at said proximal end.

2. A reduced propellant ammunition cartridge according to claim 1 wherein said pliable tube is made of aluminum metal.

3. A reduced propellant ammunition cartridge according to claim 1 wherein said pliable tube is made of plastic.

4. A reduced propellant ammunition cartridge according to claim 1 wherein the thickness of said pliable tube is predetermined to control the maximum quantity of powder charge contained within said ammunition cartridge.

5. A process for the production of a reduced propellant ammunition cartridge which comprises:

providing a cylindrical case defined by a rear end portion with a primer flash hole centered therein, a front end portion having a predetermined inside diameter, a powder chamber of diameter greater than said predetermined inside diameter and a tapered neck portion integrally joining said front end portion to said powder chamber, providing a projectile having a cylinderical portion to be ceased in said front end portion of said cylindrical case, providing a pliable tube defined by a proximal end, a distal end and a central body portion integrally joining said proximal end to said distal end, said distal end and central body portion of said pliable tube having an outside diameter slightly less than said predetermined inside diameter, said pliable tube being of predetermined length defined by the distance from said rear end portion of said cylindrical case to approximately the junction of said tapered neck portion with said front end portion of said cylindrical case, providing a primer cap and installing it in said rear end portion of said cylindrical case, inserting said pliable tube into said cylindrical case to contact said distal end with said rear end portion of said cylindrical case, expanding said proximal end of said pliable tube to contact said neck portion of said cylindrical case, charging a predetermined volume of propellant into said pliable tube through said front end portion of said cylindrical case, and installing said cylinderical portion of said projectile in said front end portion of said cylindrical case.

6. A process for the production of a reduced propellant ammunition cartridge which comprises:

providing a cylindrical case defined by a rear end portion with a primer flash hole centered therein, a front end portion having a predetermined inside diameter, a powder chamber of diameter greater than said predetermined inside diameter and a tapered neck portion integrally joining said front end portion to said powder chamber, providing a projectile having a cylinderical portion to be ceased in said front end portion of said cylindrical case and a tapered base, providing a pliable tube defined by a proximal end, a distal end and a central body portion integrally joining said proximal end to said distal end, said distal end and central body portion of said pliable tube having an outside diameter slightly less than said predetermined inside diameter, said pliable tube being of predetermined length defined by the distance from said rear end portion of said cylindrical case to approximately the junction of said tapered neck portion with said front end portion of said cylindrical case, engaging said tapered base of said projectile with said distal end of said pliable tube positioned vertically above and axially aligned with said projectile, charging propellant into said pliable tube though said proximal end, installing said cylindrical case around said pliable tube and axially aligned with said projectile and said pliable tube, and causing said tapered end of said projectile to expand said proximal end of said pliable tube.

7. The process of claim 5 wherein the step of charging a predetermined volume of propellant into said pliable tube follows said step of expanding said proximal end of said pliable tube to contact said neck portion of said cylindrical case and said step of providing a primer cap and installing it in said rear end portion of said cylindrical case.

8. The process of claim 5 wherein the step of charging a predetermined volume of propellant into said pliable tube precedes said step of expanding said proximal end of said pliable tube to contact said neck portion of said cylindrical case and said expanding of said proximal end is accomplished by engagement of said tapered base of said projectile with said proximal end of said pliable tube.

* * * * *